US006988335B2

(12) United States Patent
Eyers

(10) Patent No.: US 6,988,335 B2
(45) Date of Patent: Jan. 24, 2006

(54) GUTTER MEMBER AND SHIELDING DEVICE INCORPORATING SAME

(76) Inventor: Michael Bruce Eyers, 20 Curringa Road, Kariong, New South Wales, 2250 (AU)

( * ) Notice: Subject to any disclaimer, the term of this patent is extended or adjusted under 35 U.S.C. 154(b) by 0 days.

(21) Appl. No.: 10/400,571

(22) Filed: Mar. 28, 2003

(65) Prior Publication Data

US 2003/0167699 A1 Sep. 11, 2003

Related U.S. Application Data

(63) Continuation of application No. PCT/AU01/01217, filed on Sep. 28, 2001.

(30) Foreign Application Priority Data

Sep. 28, 2000 (AU) ..... PR0425
Dec. 15, 2000 (AU) ..... PR2110
Apr. 24, 2001 (AU) ..... PR4560

(51) Int. Cl.
*E04D 13/064* (2006.01)

(52) U.S. Cl. ..... 52/12; 52/14; 52/15

(58) Field of Classification Search ..... 52/11–12, 52/14–15, 97; 248/48.1; 210/474
See application file for complete search history.

(56) References Cited

U.S. PATENT DOCUMENTS

| | | | | | |
|---|---|---|---|---|---|
| 406,233 | A * | 7/1889 | Phelps | 52/12 |
| 891,405 | A * | 6/1908 | Cassens | 52/12 |
| 3,388,555 | A * | 6/1968 | Foster | 52/12 |
| 4,435,925 | A * | 3/1984 | Jefferys | 52/12 |
| 4,493,588 | A * | 1/1985 | Duffy | 52/12 |
| 4,631,875 | A | 12/1986 | Olson | |
| 4,696,131 | A * | 9/1987 | Schreffler | 52/11 |
| 4,858,396 | A | 8/1989 | Rose et al. | |
| 5,459,965 | A * | 10/1995 | Meckstroth | 52/12 |
| 5,611,175 | A | 3/1997 | Sweers | |
| 6,073,398 | A | 6/2000 | Williams | |
| 6,256,933 | B1 * | 7/2001 | Kuhns | 52/13 |
| 6,536,165 | B2 * | 3/2003 | Pilcher | 52/12 |

FOREIGN PATENT DOCUMENTS

| | | | |
|---|---|---|---|
| GB | 2002046 | A | 2/1979 |
| JP | 09-279782 | A | 10/1997 |
| JP | 11-336270 | A | 12/1999 |
| JP | 11-350675 | A | 12/1999 |
| WO | WO 95/02100 | A1 | 1/1995 |
| WO | WO 96/34163 | A1 | 10/1996 |

* cited by examiner

*Primary Examiner*—Winnie Yip
(74) *Attorney, Agent, or Firm*—Birch, Stewart, Kolasch & Birch, LLP

(57) ABSTRACT

A gutter member including a channel portion adapted to receive and carry away water flowing from the roof structure; and a cover portion extending above and at least partially covers the channel portion. The cover portion is adapted to support sliding travel of solid or semi-solid material, such as snow and ice, from the roof structure over the channel portion. Preferably, the cover portion extends inwardly from an outer side of the channel portion to at least partially cover it. The cover portion presents an upper bearing surface that extends across more than half and the entire lateral width of the channel portion to act as a bridge for the solid and semi-solid material. The gutter member includes a mounting portion at which the gutter member is adapted to be secured at the periphery of the roof structure, the mounting portion being an integral extension of the cover portion.

11 Claims, 6 Drawing Sheets

GUTTER MEMBER AND SHIELDING DEVICE INCORPORATING SAME

This application is a Continuation of copending PCT International Application No. PCT/AU01/01217 filed on Sep. 28, 2001, which was published in English and which designated the United States, and on which priority is claimed under 35 U.S.C. § 120, the entire contents of which are hereby incorporated by reference.

TECHNICAL FIELD

The present invention relates to water collection systems, and more particularly to a gutter member and shielding device for collecting and channelling rainwater. The invention has been designed especially, but not exclusively for use in alpine environments and is described in that context.

BACKGROUND TO THE INVENTION

In alpine environments snow and ice can build up on rooftops and form substantial blocks or sheets of solid or semi-solid material. On pitched or gabled roof structures, these sheets or blocks of snow and/or ice will often break up and slide off the rooftop onto the ground below. When this happens, standard roof guttering which is typically in the path of the sliding snow and ice can be struck and damaged and, in some cases, even completely torn away from the building.

Another problem with standard guttering in alpine environments is that snow and ice that slides down to the edge of a rooftop may accumulate there. If the temperature at the eaves is still below freezing an "ice dam" can form. The water from snow-melt caused higher up on the roof from the heat inside the building or from solar radiation then becomes trapped on the roof, unable to flow away in the guttering. This can lead to accelerated roof deterioration and leakage.

It would therefore be desirable to provide a new and improved gutter member for roof guttering designed to substantially avoid or minimise the above disadvantages of standard guttering in an alpine environment. In addition, it would be useful to provide such a new and improved gutter member that is also suitable for non-alpine environments, where it may effectively reduce the accumulation of leaves, twigs and other litter within the roof guttering.

Furthermore, it would be beneficial to provide a shielding device incorporating principles of the new and improved gutter member for protecting an area of ground below.

SUMMARY OF THE INVENTION

Broadly, according to one aspect, the present invention provides a gutter member for collecting and channelling rainwater run-off at a periphery of a roof structure, the gutter member including:

a channel portion adapted to receive and carry away water flowing from the roof structure; and a cover portion which extends above and at least partially covers the channel portion, said cover portion being adapted to support sliding travel of solid or semi-solid material from the roof structure over the channel portion of the gutter member.

The invention therefore provides a gutter member that enables solid or semi-solid material such as snow and ice to slide from a rooftop and to pass over the channel portion of the gutter member supported by the cover portion. In other words, the cover portion acts to shield the normally exposed channel portion from the sliding snow and ice, while still permitting water from snow-melt and/or rain to flow into the channel portion and be carried away to a drain in the usual fashion.

The gutter member of the present invention is typically elongate and, in use, is arranged to extend along an edge of the rooftop at the periphery of the roof structure in the usual fashion. The channel portion extends longitudinally of the gutter member and, in its in-use orientation, has an inward or inner side corresponding to the side nearer the roof structure, and an outward or outer side corresponding to the side further from the roof structure. Such terms as "inner", "inward", "outer" and "outward" used herein in referring to parts of the gutter members are therefore to be understood in this context.

In a preferred embodiment of the invention, the cover portion extends inwardly from an outer side of the channel portion to at least partially cover it. The cover portion preferably presents a bearing surface which extends across more than half the lateral width of the channel portion. The bearing surface is typically an upper surface of the cover portion and it is preferably substantially continuous, being adapted to carry or bear the solid and semi-solid material as it travels from the rooftop across the cover portion. Thus, the cover portion preferably comprises an element formed from a relatively stiff sheet material which defines a substantially continuous bearing surface to act as a bridge over the channel portion of the gutter for the solid and semi-solid material. Preferably the bearing surface extends over at least 75%, and more preferably at least 90%, of the lateral width of the channel portion.

In a preferred embodiment of the invention the cover portion is integrally formed with the channel portion. More preferably, the whole gutter member is integrally formed. The gutter member is preferably fabricated from a sheet material, which may be extruded, rolled or moulded into the final gutter member shape. In high altitude alpine environments, polymer plastics and fibre-reinforced polymer composites, such as fibreglass, are considered preferable due to their flexibility, and their resistance to corrosion, micro-cracking and UV-related deterioration. Curved section profiles can also be readily moulded with such materials. For low altitude urban environments, the fabrication material is preferably a sheet metal such as aluminium or steel.

In a preferred embodiment of the invention, the gutter member is adapted to resiliently flex or deform to facilitate sliding travel of the solid or semi solid material over the channel portion. This resilient deformation may occur in the cover portion of the gutter member, in the channel portion, or in both the cover portion and the channel portion. Essentially, the gutter member is adapted to deform in such a way as to reduce the friction which retards the sliding movement of the snow and/or ice, while at the same time increasing the force which is driving that movement. This occurs by the gutter member being able to flex downwardly under the weight of the snow and ice. The downward flexing decreases the component of weight force normal to the gutter cover portion which supports the material, and increases the component of weight force parallel to the direction of travel. Expressed more simply, the gutter member is adapted to resiliently flex or bend under the weight of the snow and ice to increase its angle of decent as it passes across the outer surface of the gutter member cover portion. The fabrication material and the design of the gutter member regarding its cross-sectional thickness and shape can be manipulated to tailor the desired degree of flexibility.

In a preferred embodiment of the invention, the gutter member includes a mounting portion at which the gutter member is adapted to be secured at the periphery of the roof structure. In one particular form, this mounting portion includes an extension or part of the cover portion. That is, the gutter member is adapted to be secured at the periphery of the roof structure in such a way that water running off the roof structure flows directly onto and across the cover portion of the gutter member. Accordingly, the cover portion may be adapted to form an approximately continuous extension of the roofing material.

In this particular embodiment of the invention, the cover portion of the gutter member substantially entirely covers the channel portion. The channel portion is arranged depending below the cover portion, and the cover portion includes one or more aperture there-through in fluid communication with the channel portion of the gutter member. In this way, water flowing from the roof structure passes directly onto the cover portion of the gutter member and then encounters the aperture (or apertures) through which it passes into the channel portion. The water is then carried away by the channel portion to a drain in the usual fashion. Solid or semi-solid material, however, such as sheets or blocks of snow and ice which slide from the roof structure are generally unable to pass through the apertures into the channel portion of the gutter. The cover portion of the gutter member supports this material so that it simply passes over the apertures, and thus over the channel portion, and then unhindered off an outer edge of the gutter member. The applicant has found that 'tear-drop' shaped apertures are particularly preferred for enhanced flow of water into the channel portion, although apertures of any shape would suffice.

In a particularly preferred embodiment of the invention, the cover portion includes a dip or trough extending longitudinally thereof in the vicinity of the aperture or apertures communicating with the channel portion. The dip or trough in the vicinity of the apertures enhances the passage of water from the cover portion into the channel portion. In the case of heavy rainfall, for example, where a large volume of water is flowing from the roof structure, the trough in the cover portion serves to maximise the transfer of water into the channel portion. Indeed, the gutter member of the invention may include more than one longitudinally extending dip or trough arranged in parallel with two corresponding rows of apertures for the passage of water into the channel portion below.

In an alternative embodiment of the invention, the mounting portion does not include an extension or part of the cover portion. In this embodiment of the invention, the gutter member is adapted to be secured at the periphery of the roof structure in such a way that water running off the roof structure flows directly into the channel portion. The gutter member is configured so that when it is installed at a roof structure a narrow gap is provided between the edge of the roofing material and the cover portion of the gutter member. This gap provides direct communication with the channel portion and rainwater run-off from the rooftop is able to flow through it. The gap is sufficiently narrow that a solid or semi-solid sheet of sheet snow or ice may pass directly from the rooftop onto the cover portion, which then supports continued travel of that material over the channel portion and away off an outer edge of the gutter member.

Naturally, according to another aspect, the present invention provides a guttering assembly for installation at the periphery of a roof structure, the assembly including one or more gutter member as described in any one of the embodiments above.

A further inventive aspect, which generally incorporates the broad principles of the gutter member described above, relates to a shielding device for protecting sensitive ground areas. In this case, the broad principles of the gutter member described above are not for use at a periphery of a roof structure. Rather, the shielding device is most preferably designed to protect snow cover on a ski field piste from deterioration due to excessive exposure to sun and and/or rain. However other, non-alpine uses, such as agricultural applications, are also envisaged for the inventive shielding device.

Broadly, this inventive aspect provides a shielding device for protecting an area of ground from excessive exposure to the elements. The device includes a panel member adapted to extend over and shield the ground area, and an elongate gutter member associated with the panel member for collecting and channelling rainwater run-off from the panel member. In a particularly preferred embodiment, the gutter member includes a channel portion adapted to receive and carry away water which falls upon the panel member and a cover portion which extends above and at least partially covers the channel portion to support travel of solid or semi-solid material, such as snow and ice, over the channel portion and thereby inhibit its collection.

Thus, the shielding device of the invention may be designed to protect an area of snow cover at a ski resort from excessive sun and rain by shielding the snow from the adverse effects of those natural elements, and by collecting and diverting any rainwater which falls on the panel member. The panel member may also be adapted to shield the ground area from wind, which can also adversely affect snow cover. A wind shield may also permit a more accurate distribution of any man made snow in that area.

In a preferred embodiment of the invention the gutter member is arranged along an edge region of the panel member to receive water falling on and flowing from an upper surface thereof. Therefore, the shielding device is designed to be oriented with the panel member pitched at an angle and declining towards the gutter member. In this way, any rainwater falling upon the upper surface flows naturally under gravity to the gutter member for collection.

In one embodiment of the invention, the channel portion for the gutter of this shielding device is substantially enclosed by the cover portion. The cover portion includes a plurality of apertures there-through providing fluid communication with the channel portion. These apertures are preferably elliptical or tear-drop shaped.

In one embodiment of the invention, the panel member is made from a flexible material, such as a sheet of fabric or polymer film. Alternatively, however, the panel member may have a rigid construction, fabricated for example from metal, polymer plastic, fibre-reinforced polymer composite or even simply timber. Such a rigid panel member may also be in the form of a moveable louvre. The shape of the panel member is not critical, but it will preferably have a generally planar expanse, which for convenience is preferably rectangular.

In a preferred embodiment of this invention, the shielding device forms part of a shielding system including a plurality of shielding devices. These shielding devices are preferably arranged together in a side-by-side or parallel array to cover and protect an extensive area of ground.

In accordance with a further aspect, the invention relates to a shielding system for protecting an area of ground which includes a plurality of shielding devices as described in any form above, and a support means for supporting the respective said shielding devices above the area of ground, the shielding devices being spaced apart with the panel member of each device being pitched at an angle to the horizontal and declining towards its respective gutter member.

The applicant has found that a shielding system according to the above form when installed in snowfields is able to preserve the condition of the snow on the protected area. The shielding system is able to do this by disposing the shielding device at an angle to the horizontal so that they can effectively collect and divert any rainwater which falls on the panel members whilst not unduly restricting snow from falling on the protected ground.

In a particularly preferred embodiment, the shielding devices are operative to be disposed in a substantial parallel array.

In one embodiment, the shielding devices are operative to be fixed to said support means with the respective panel members of the shielding devices being fixed at the angle to the horizontal. In an alternative embodiment, the shielding devices are movably mounted to the support means so as to allow for adjustment of the angle of the respective shielding devices so as to enable fine tuning of the system to achieve its primary aim of collecting and diverting rainwater from the protected area whilst still allowing snow to fall on that protected area.

A shielding system in accordance with this aspect of the invention is designed to be strategically placed on snowfields so as to protect either high traffic and/or critical sections of the piste which provide access from the ski field centre to sections of the snowfields.

BRIEF DESCRIPTION OF THE DRAWINGS

The above and further features of the present invention will be more fully appreciated from the following detailed description of preferred embodiments of the invention with reference to the accompanying drawings, in which like reference characters designate like features, and in which.

DETAILED DESCRIPTION OF THE PREFERRED EMBODIMENTS

Figure 1:
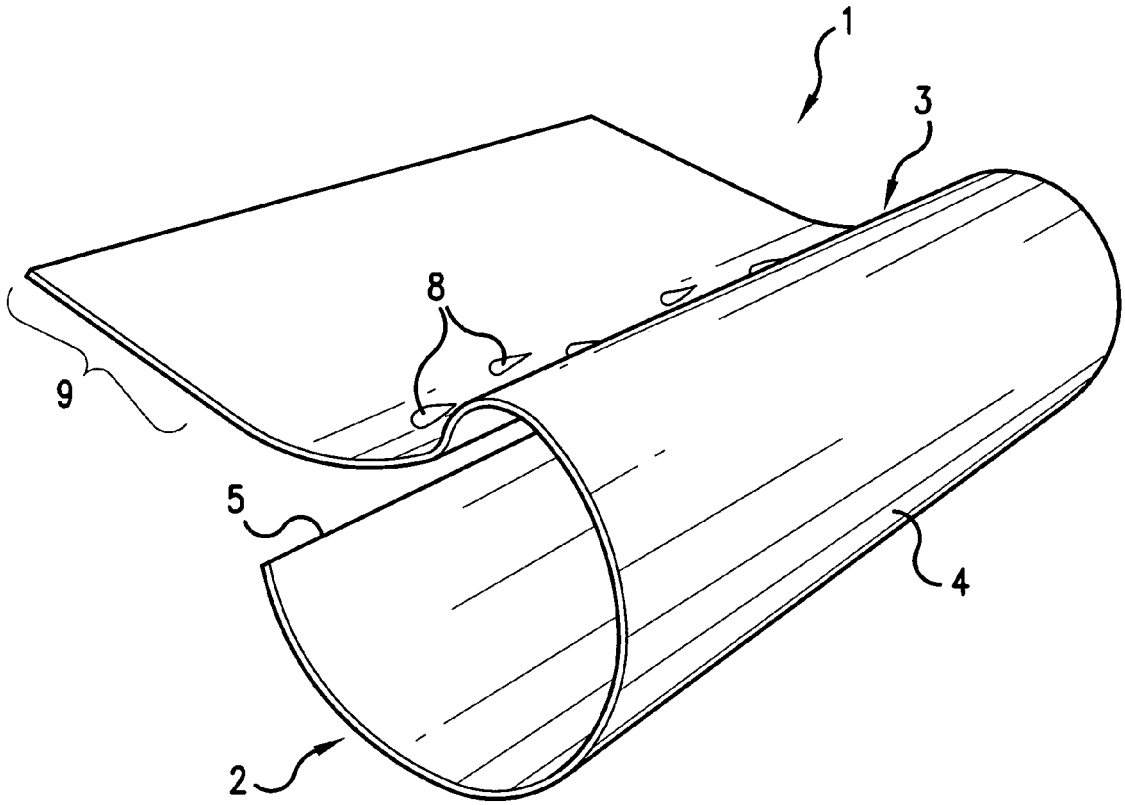
FIG. 1 is a perspective view of a gutter member according to a first preferred embodiment of the invention.
Figure 2:
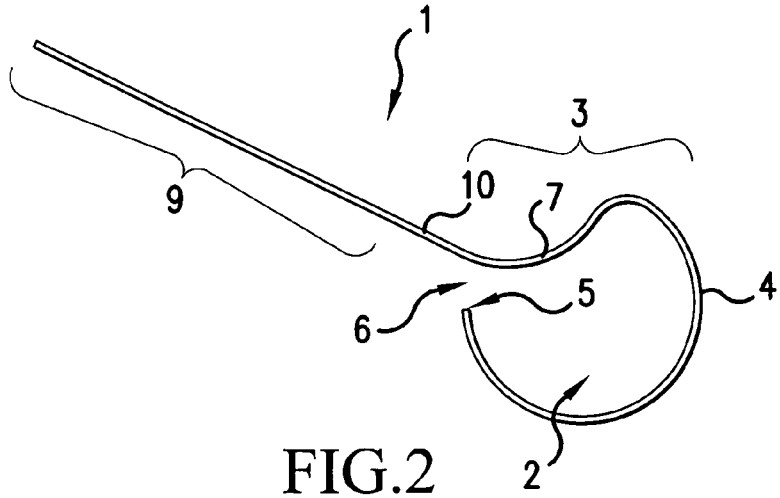
FIG. 2 is an end view of the gutter member shown in FIG. 1.
Figure 3:
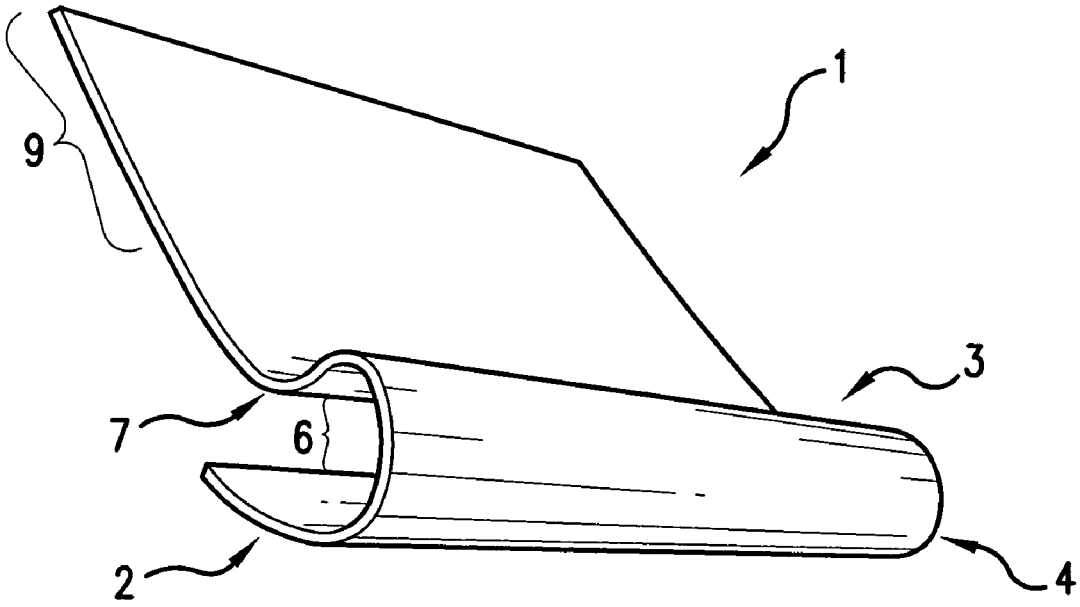
FIG. 3 is a perspective view of a gutter member very similar to the embodiment shown in FIG. 1.

Referring to FIGS. 1 to 3 of the drawings, the invention provides an elongate gutter member (1) for collecting and channelling rainwater or snowmelt run-off at a periphery of a roof structure (not shown). The gutter member (1) is integrally formed from relatively thin sheet material, such as steel or a fibre-reinforced polymer composite, and includes a channel portion (2) which is adapted to receive water flowing from the roof structure and to conduct it away to a drainage pipe (e.g. a down pipe). The channel portion (2) depends below a cover portion (3) to which it is integrally connected at a rounded outer edge region (4) of the gutter member. The cover portion (3) extends above and substantially entirely covers the channel portion (2). Although the channel portion could be constructed so that it is entirely enclosed below the cover portion (3), in this embodiment the channel portion has a free inner edge (5) defining an inward opening or mouth (6). This opening (6) facilitates the clearing of any blockages from the channel portion, as will be described briefly later.

The cover portion (3) of the gutter member includes a longitudinally extending trough or dip (7) through the base of which are formed a plurality of approximately tear-drop shaped apertures (8) that provide fluid communication with the channel portion (2). These apertures (8) enable water flowing over the surface of the cover portion (3) to pass into the channel portion (2) where it can then be directed to the drain. The trough or dip (7) facilitates the collection and transfer of water to the channel portion (2) by providing some resistance to the water simply flowing off the outer edge (4) of the gutter member.

The cover portion (3) further includes an integral extension (9) adapted to facilitate mounting of the gutter member (1) at the periphery of the roof structure. In this embodiment, the mounting portion (9) is designed to be inserted under the roofing material (eg between the batons or roof truss and the roofing material) where it may be then fastened as appropriate using nails or screws or the like. In this way, the cover portion (3) is able to form a substantially continuous extension from the roofing material, thereby enabling water flowing from the rooftop to flow directly onto to the cover portion of the gutter member.

In an alpine environment, when blocks or sheets of snow or ice slide from the rooftop and encounter the gutter member (1) of the present invention, those blocks or sheets will pass directly onto an upper bearing surface (10) of the cover portion (3). The cover portion (3) supports the travel of the snow and ice sliding on that upper surface across the apertures (8) at the base of the trough (7) and over the channel portion (2), allowing it to simply slide unhindered off the outer edge region (4) of the gutter member. The gutter member is furthermore adapted to resiliently flex or bend downwardly under the weight of the snow and ice to facilitate this travel of the sheets or blocks over the gutter member. In this particular case, the flexing or bending primarily occurs in the cover portion (3) in the vicinity of the trough (7).

The channel portion (2) is also able to resiliently flex due to the free inner edge region (5). If ice happens to build up in the channel portion over time, the channel portion is able to resiliently flex downwardly under the weight of the ice which thereby releases or ejects the ice build-up through the now expanded opening (6) under gravity. Furthermore, an operator may also employ a water hose to flush the channel portion (2) through the mouth opening (6).

Figure 4:
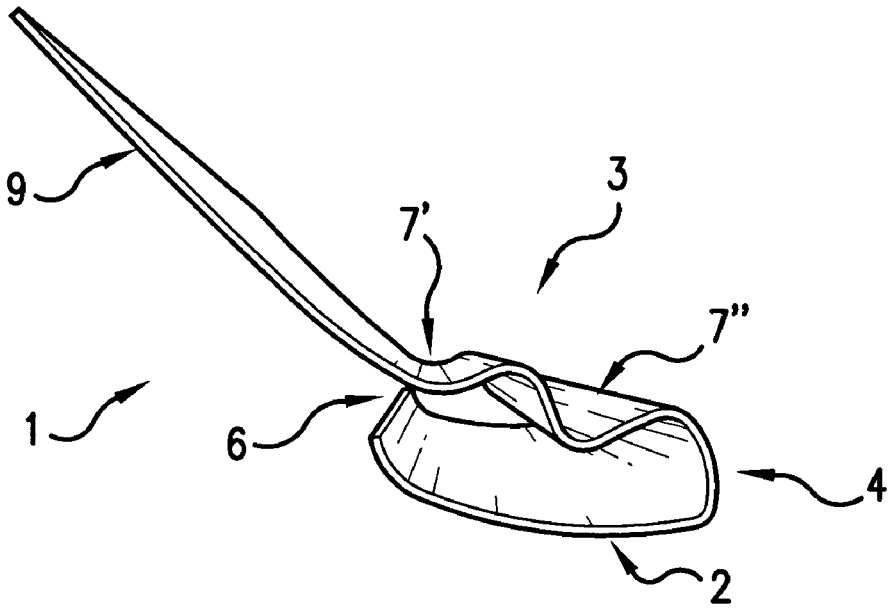
FIG. 4 is a perspective end view of a gutter member according to a second preferred embodiment of the invention.

FIG. 4 of the drawings shows a gutter member (1) very similar to that shown in FIG. 1, with the main difference being that in this case the gutter member has two troughs or dips (7', 7") extending longitudinally thereof in the cover portion (3). This "double trough" configuration is particularly suited to areas of heavy rainfall. The two troughs or dips (7', 7") are substantially parallel and each incorporates a plurality of apertures (8) in its base to provide fluid communication with the channel portion (2) below. The first trough or dip (7') has fewer apertures (8) to ensure strength along the region that will receive the greatest impact force from a sliding ice pack. The second trough or dip (7") typically has a greater number of apertures. The features of this gutter member are otherwise essentially equivalent to those described with reference to FIGS. 1 to 3.

Figure 5:
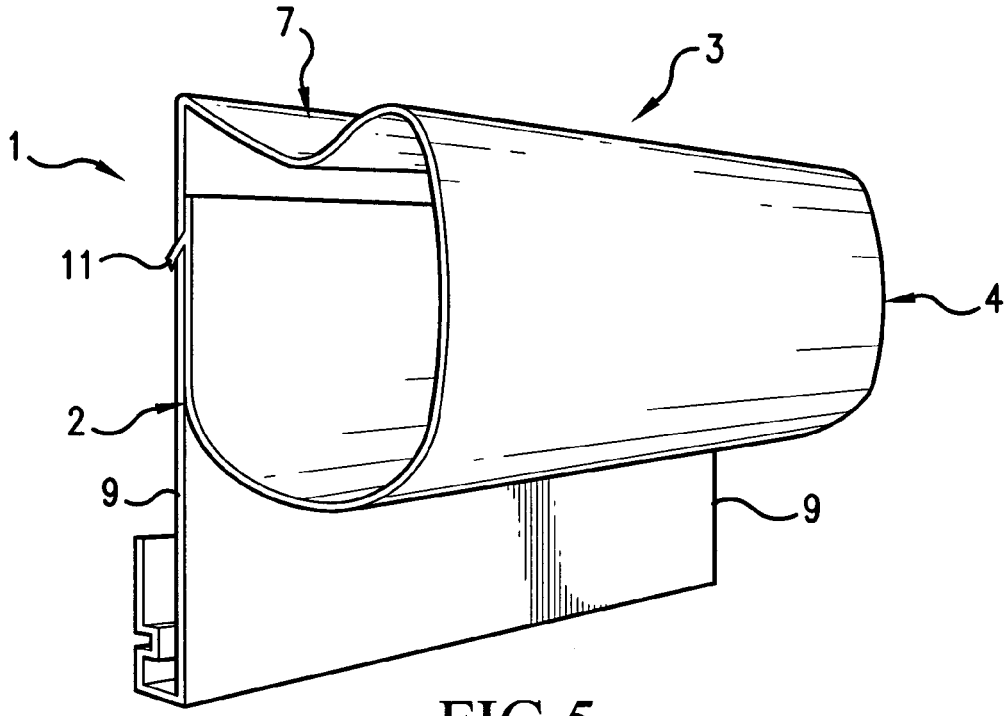
FIG. 5 is a perspective view of a gutter member according to a third preferred embodiment of the invention.
Figure 6:
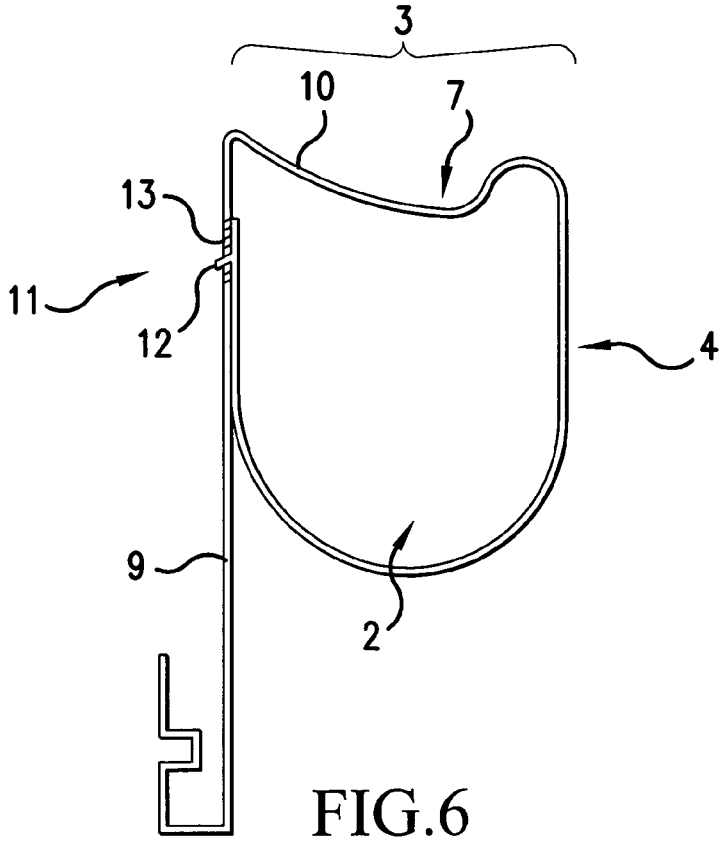
FIG. 6 is an end view of the gutter member shown in FIG. 5.

Referring now to FIGS. 5 and 6, a third embodiment of the inventive gutter member (1) is illustrated. In these drawings, like reference numerals designate like parts with respect to the gutter members illustrated in FIGS. 1 to 4. Accordingly, the gutter member (1) of FIGS. 5 and 6 again includes a channel portion (2) depending below a cover portion (3). The cover portion has a trough (7) with apertures (not shown) formed there-through, and defines a bearing surface (10) to support sliding travel of snow and ice over the channel portion (2). The gutter member is again an integral construction from a sheet material, and is formed for example by rolling, extrusion or moulding.

One important difference of this embodiment from those already described, however, is that the mounting portion (9), while still being an integral extension of the cover portion (3), now extends substantially vertically. The mounting portion (9) in this case is adapted to be fastened or secured to a fascia board (not shown) directly below a periphery of the roofing material. Accordingly, the cover portion (3) is still designed to be located immediately adjacent the roofing material to enable solid and semi-solid material sliding from the rooftop to pass directly onto the cover portion and to travel over the channel portion (2) of the gutter member.

Another difference of this third embodiment is that the inner edge region (5) of the channel portion (2) is not free like before. In this instance it is fastened via an adjustable clip arrangement (11) to the mounting extension (9). The clip arrangement (11) includes a series of lug projections (12) at the inner edge (5) of the channel portion, and a corresponding series of slot sets (13) into which the lugs (12) are adapted to be inserted. This clip arrangement is adjustable in the sense that each lug (12) may be inserted into any one of the slots in its corresponding slot set (13). By altering the slot selection along the length of the channel portion, the slope (and thus flow direction) of the channel portion (2) can be adjusted.

Figure 7:
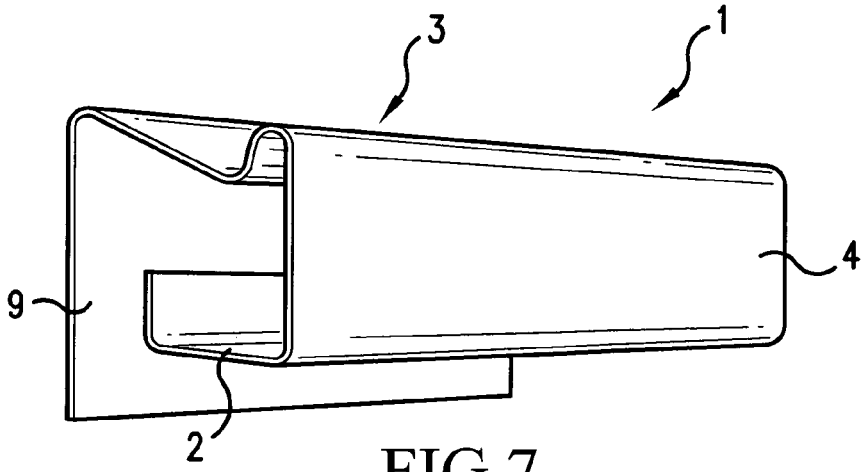
FIG. 7 is a perspective view of a gutter member according to a fourth preferred embodiment of the invention.

FIG. 7 of the drawings shows a fourth gutter member embodiment that includes features of both the first and third embodiments. In this instance, the mounting portion (9) is a substantially vertical extension to be secured at a fascia board as in the embodiment of FIGS. 5 and 6. The channel portion (2), however, has a free edge (5) creating an opening or mouth (6) as in the embodiment of FIGS. 1 to 3. The gutter member (1) of this fourth embodiment also has a much more rectangular geometry, with the outer edge region (4) being substantially vertical and the channel portion also being substantially rectangular.

Figure 8:
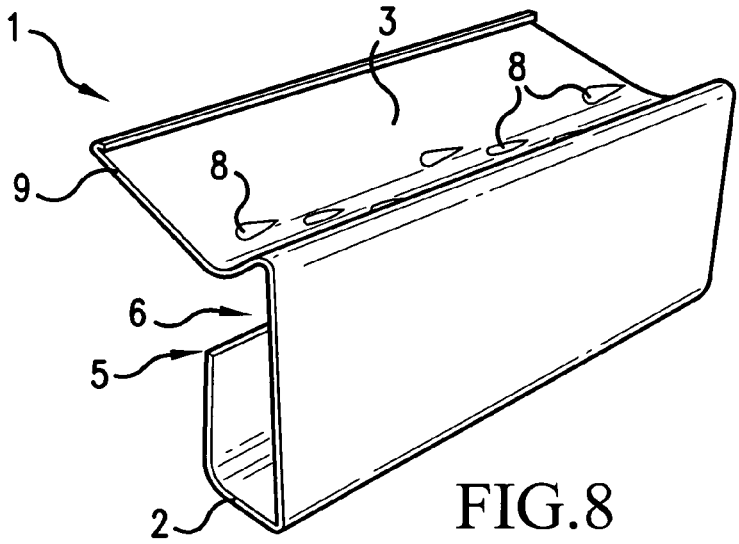
FIG. 8 is an angled perspective view of a gutter member according to a fifth preferred embodiment of the invention.
Figure 9:
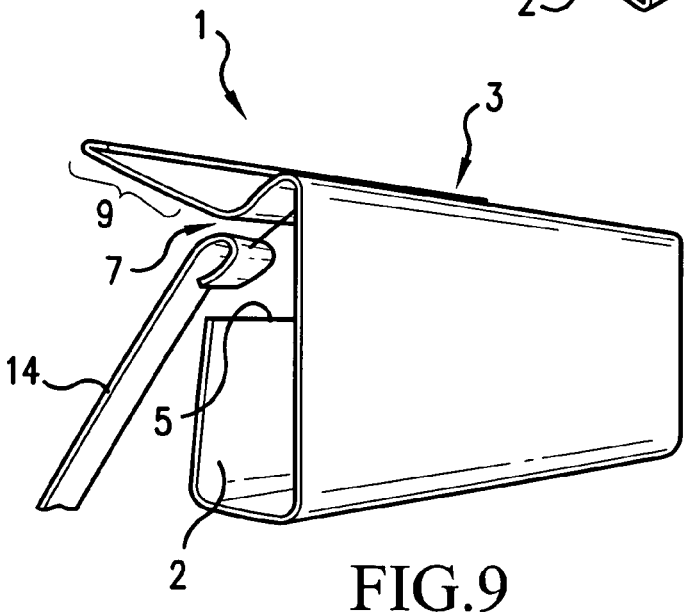
FIG. 9 is another perspective view of the gutter member shown in FIG. 8.

FIGS. 8 and 9 illustrate a fifth embodiment of the gutter member (1), which is similar to the embodiment of FIG. 1 except that the channel portion (2) is substantially deeper and rectangular in configuration. As shown in FIG. 9, a prop or support strut (14) may be provided.

Figure 10:
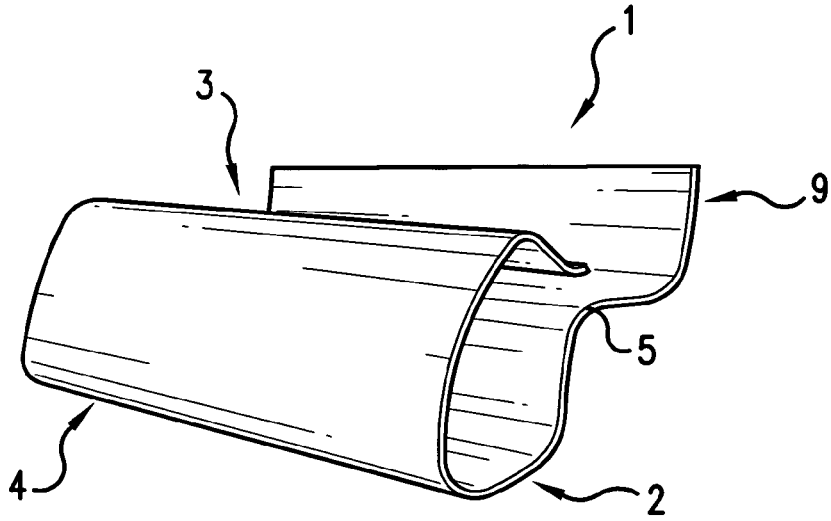
FIG. 10 is a perspective view of a gutter member according to a sixth preferred embodiment of the invention.
Figure 11:
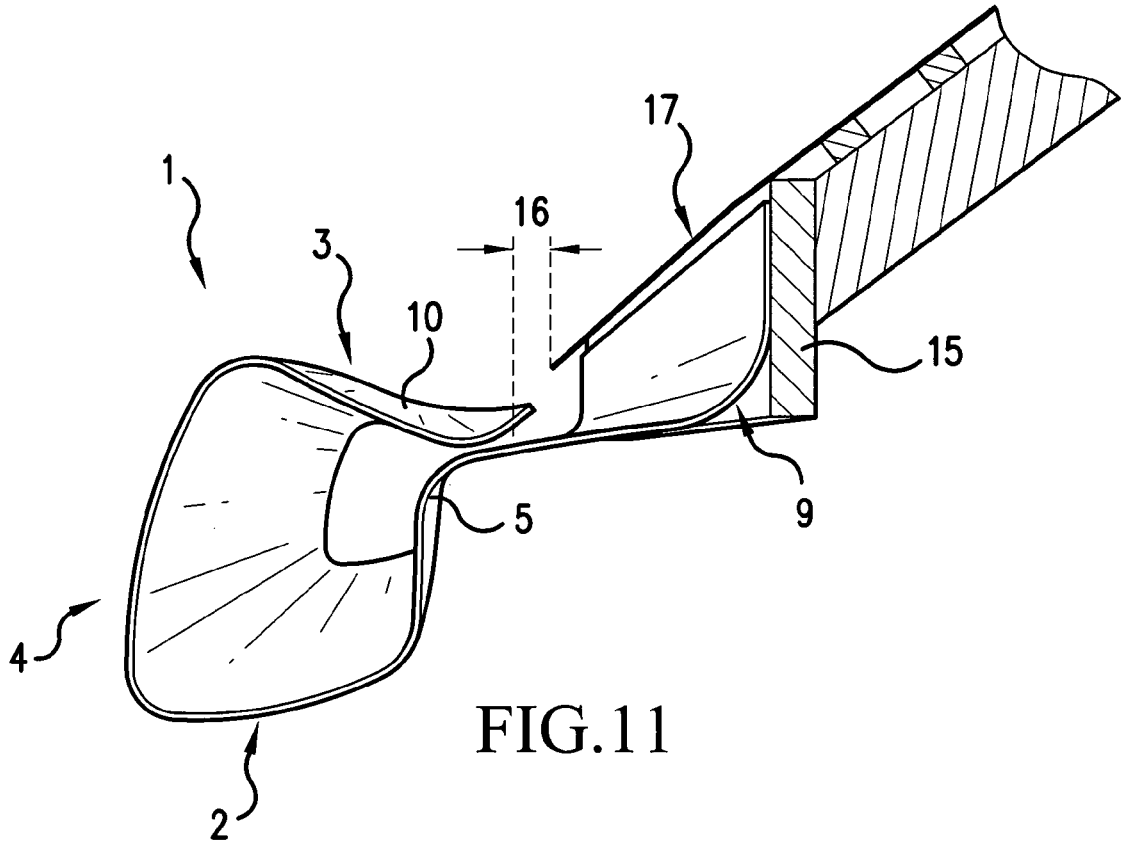
FIG. 11 is an end perspective view of the gutter member of FIG. 10 shown in relation to a roof structure in its in-use orientation.

FIGS. 10 and 11 of the drawings illustrate a sixth alternative embodiment of gutter member according to the invention. As before, like reference numerals designate like parts with respect to the gutter member embodiments previously described. Accordingly, the gutter member (1) of FIGS. 10 and 11 again includes a channel portion (2) depending below a cover portion (3). The gutter member is again also an integral construction. In this case, however, the mounting portion (9) of the gutter member does not constitute or include an extension of the cover portion (3) as it does in FIGS. 1 to 9. In this case, the mounting portion (9) is connected to (as an integral extension of) the inner edge region (5) of the channel portion (2). This mounting portion (9) is adapted to be fastened at a fascia board (15) at the periphery of the roof structure (for example with screws, bolts or other suitable fasteners) in such a way that a narrow gap (16) is provided between an edge of the roofing material (17) and the cover portion (3) of the gutter member.

Furthermore, in the embodiment of FIGS. 10 and 11, although the cover portion (3) does still substantially entirely cover the channel portion (2), it does not extend to connect or overlap with the roofing material (11) but terminates at the gap (16). Thus, the upper bearing surface (10) of the cover portion still extends across substantially the entire lateral width of the channel portion (3), ie between the outer edge region (4) and the inner edge region (5). But the gutter member configuration this time leaves the gap (16) between the cover portion and a peripheral edge of the rooftop. This gap (16) provides direct fluid communication with the channel portion (2) enabling rainwater run-off from the rooftop to flow through it into the channel portion. The gap (16), however, is sufficiently narrow, and the upper bearing surface (10) of the cover portion (3) is sufficiently curved and oriented, that a sheet of snow or ice nevertheless passes directly over the gap (16) onto the cover portion (3) as it slides off the rooftop. The cover portion (3), assisted by resilient flexing of the gutter member therefore supports the continued travel of that snow and ice over the channel portion to slip away off the outer edge region (4) of the gutter member. The resilient flexing in this case would most likely occur partly in the cover portion (3) which extends inwards like a cantilever from the outer side of the channel portion, and partly in the region at the top of the inner side of the channel portion, where it joins the mounting portion (9).

The outer side (12) of the channel portion presents a large surface area at an angle to enhance absorption of solar radiation to further minimise the prospect of an "ice dam" forming at the gutter member.

Figure 12:
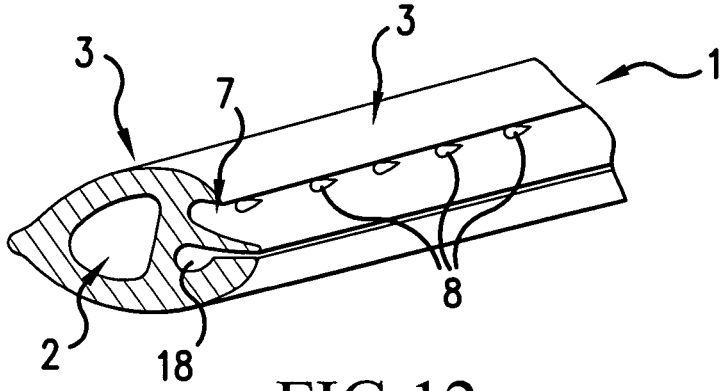
FIG. 12 is another perspective end view of a gutter member for a shielding device according to an embodiment of the invention.
Figure 13:
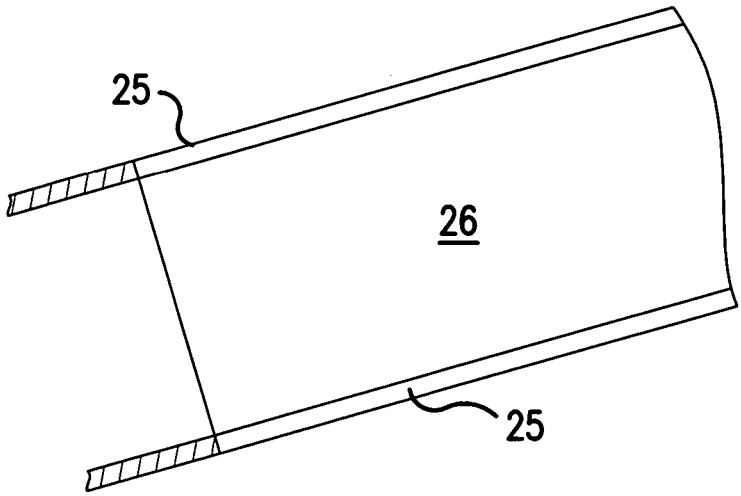
FIG. 13 is a partial plan view of a panel member for use with the gutter member of FIG. 12 in a shielding device according to a preferred embodiment of the invention.
Figure 14:
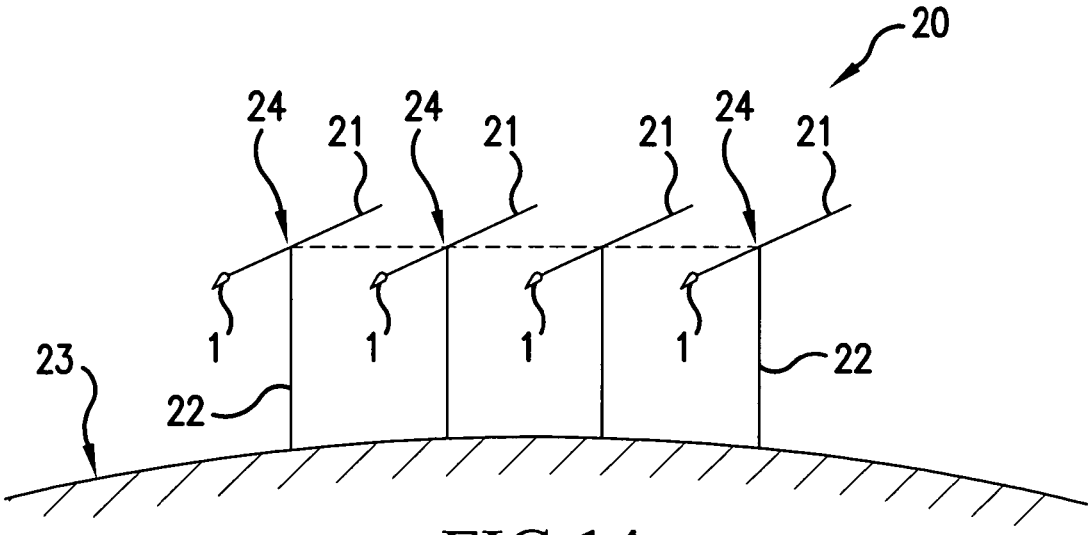
FIG. 14 is a schematic end view of a shielding system according to a preferred embodiment of the invention.

Referring now to FIGS. 12 to 14, a snow-shielding system (20) illustrated schematically in FIG. 14 comprises a plurality of elongate rectangular shielding devices (21) arranged in parallel, in a louvre-type array. The devices (21) are mounted on a supporting framework (22) elevated above the ground level (23). The degree of elevation may vary depending on the application. In this case, however, where the shielding system (20) is acting to protect the snow cover of a ski field in an alpine environment, the height of the devices (21) should be sufficient to enable skiers, snow-grooming equipment and vehicles to pass underneath, and also to enable distribution of man made snow below the panel members.

Each device (21) is mounted at an angle that is preferably adjustable about a pivot connection (24) at which each device is connected to the supporting frame (22). Each shielding device (21) also includes a panel member (26) and an elongate gutter member (1) extending along the lower longitudinal edge of each one of the panel members. The gutter member (1) is designed to collect and divert water from the panel member and is also operative to withstand blocks or sheets of snow and ice passing over the shielding device. As such the gutter member in accordance with any of the embodiments disclosed above is ideally suited for use with the shielding device (21).

With reference to FIG. 12, an alternative embodiment of the gutter member (1) is shown for the shielding devices (21) which includes an aerofoil shape to provide an aerodynamic profile in the event of strong winds. This gutter member is furthermore formed from a substantially rigid and robust material such as a metal, polymer plastic, or fibre-reinforced polymer composite. The gutter member (1) includes a channel portion (2) for receiving and carrying away rainwater which falls upon the respective panel member (26), and a cover portion (3) which extends over and substantially entirely covers the channel portion (2) so that solid or semi-solid material such as snow and ice is able to simply pass over the channel portion and onto the ground below. The cover portion is provided with a row of elliptical or tear-drop shaped apertures (8) at the base of a dip or trough (7) in the cover portion (3) and those apertures provide fluid communication with and enable transfer of rainwater or snow-melt to the channel portion (2).

Each of the panel members (26) is a substantially planar and rigid element having a bead (25) extending along each longitudinal edge thereof to facilitate connection with the gutter member (1). Each gutter member has a corresponding recess (18) for receiving the panel member bead (25) in a sliding fit therein.

The shielding devices (21) are designed to shade the area of snow below them from excessive sun and to also shelter that area of snow from the adverse effects of rainfall. Any rain that does fall in that area is caught by the panel members and directed into the respective gutter member channel portions for delivery to a drain.

A major advantage of the louvre configuration is that undesirable weather conditions such as rain may predominantly come from a single direction. In Australian snowfields, for example, the snow fall tends to come predominantly from the south, while the rainfall tends to come predominantly from the north. Accordingly, a shielding device according to this invention can be arranged to present the panel members facing in the northerly direction, while remaining open to the south enabling snow falls to pass through.

It will be appreciated that various alterations and/or additions in the particular construction and arrangement of parts for the gutter member and shielding device of the invention previously described may be made without departing from the spirit or ambit of the present invention.

What is claimed is:

1. A gutter member for collecting and channelling rainwater run-off at a periphery of a roof structure, the gutter member including:

a channel portion receiving the rainwater run-off from the roof structure and for carrying away the rainwater run-off from the roof structure, the channel portion having a free inner edge which defines an inward opening to the channel portion, the channel portion being resiliently flexible downwardly to facilitate release through the opening of material which may accumulate therein; and a cover portion extending forwardly and downwardly from an upper bearing surface and turning outwardly and upwardly to an outer edge region, the cover portion extending above and covering the channel portion and the free inner edge, said cover portion being adapted to support sliding travel of solid or semi-solid material from the roof structure over the channel portion of the gutter member, and the free inner edge opening away from the outer edge region, the cover portion including a dip or trough between the upper bearing surface and the outer edge region, the dip or trough and the upper bearing surface forming a substantial continuous surface, the dip or trough extending longitudinally with respect to the gutter member and defining an upwardly facing concave section of the cover portion, a base of dip or trough including a plurality of apertures therethrough providing fluid communication with the channel portion;

wherein the gutter member is resiliently flexible to facilitate the sliding travel of the solid or semi-solid material over the channel portion.

2. A gutter member according to claim 1, wherein the cover portion is resiliently flexible downwardly to facilitate the sliding travel of the solid or semi-solid material over the channel portion.

3. A gutter member according to claim 2, wherein the channel portion is arranged depending below the cover portion, the cover portion extending inwardly from the outer edge region.

4. A gutter member according to claim 3, wherein the channel portion depends below and is integrally connected with the cover portion at the outer edge region of the gutter member, the free inner edge which defines the inward opening, facilitating clearing of any blockages from the channel portion.

5. A gutter member according to claim 3, wherein the apertures are approximately tear-drop shaped.

6. A gutter member for collecting and channelling rainwater run-off at a periphery of a roof structure, the gutter member including:

a channel portion for receiving the rainwater run-off from the roof structure and for carrying away the rainwater run-off from the roof structure; and a cover portion extending forwardly and downwardly from an upper bearing surface and turning outwardly and upwardly to an outer edge region, the cover portion extending above and covering the channel portion, said cover portion being adapted to support sliding travel of solid or semi-solid material from the roof structure over the channel portion of the gutter member, the cover portion including a dip or trough between the upper hearing surface and the outer edge region, the dip or trough and the upper bearing surface forming a substantial continuous surface, the dip or trough extending longitudinally with respect to the gutter member and defining an upwardly facing concave section of the cover portion, a base of the dip or trough including a plurality of apertures therethrough providing fluid communication with the channel portion;

wherein the gutter member is resiliently flexible, wherein the channel portion depends below and is integrally connected with the cover portion at the outer edge region of the gutter member, wherein the channel portion has a free inner edge opposite to the outer edge region which defines an inward opening or mouth to the channel portion, and the channel portion is resiliently flexible downwardly to facilitate clearing of any blockages from the channel portion.

7. A gutter member according to claim 6, wherein the substantial continuous surface of the cover portion presents a substantially continuous bearing surface which extends across substantially the full lateral width of the channel portion, the bearing surface bearing the solid or the semi-solid material as it travels from the roof structure across the cover portion.

8. A gutter member according to claim 7, wherein the cover portion and the channel portion are integrally formed from a sheet-like polymer plastic or fibre-reinforced polymer composite material.

9. A gutter member according to claim 6, including a mounting portion at which the gutter member is adapted to be secured at the periphery of the roof structure such that water running off the roof structure flows directly onto and across the cover portion, wherein said mounting portion includes an extension of the cover portion.

10. A gutter member according to claim 9, wherein the mounting portion is adapted to form a substantially continuous extension of a roofing material.

11. A guttering assembly for installation at the periphery of a roof structure, the assembly including one or more gutter member according to claim 1 or claim 6.

* * * * *